US006508867B2

(12) United States Patent
Schoenewald et al.

(10) Patent No.: US 6,508,867 B2
(45) Date of Patent: Jan. 21, 2003

(54) VACUUM CLEANER

(75) Inventors: Michael Schoenewald, Vaihingen/Enz (DE); Kurt Haefner, Murrhardt (DE); Martin Sorg, Kirchheim (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 09/997,202

(22) Filed: Nov. 29, 2001

(65) Prior Publication Data

US 2002/0096053 A1 Jul. 25, 2002

Related U.S. Application Data

(63) Continuation of application No. PCT/EP00/02937, filed on Apr. 1, 2000.

(30) Foreign Application Priority Data

Jun. 12, 1999 (DE) ..... 199 26 828

(51) Int. Cl.[7] ..... B01D 47/02

(52) U.S. Cl. ..... 96/333; 15/353; 55/DIG. 3; 96/342; 96/350; 96/351

(58) Field of Search ..... 95/226; 96/333, 96/329, 337, 340, 341, 342, 348, 349, 350, 351; 15/353; 55/DIG. 3

(56) References Cited

U.S. PATENT DOCUMENTS

| | | | | |
|---|---|---|---|---|
| 2,233,167 | A | * | 2/1941 | Holm-Hansen |
| 2,539,867 | A | | 1/1951 | Schnabel |
| 2,954,095 | A | * | 9/1960 | Brock |
| 3,234,713 | A | * | 2/1966 | Harper et al. |
| 4,463,474 | A | * | 8/1984 | Jacobs |
| 4,547,206 | A | * | 10/1985 | Sovis et al. |
| 5,192,344 | A | * | 3/1993 | House |
| 5,199,963 | A | | 4/1993 | Scarp |
| 5,829,092 | A | | 11/1998 | Hobbs |
| 5,958,113 | A | * | 9/1999 | Collins |
| 6,206,955 | B1 | * | 3/2001 | Pietrobon |

FOREIGN PATENT DOCUMENTS

| | | |
|---|---|---|
| DE | 515927 | 1/1931 |
| DE | 197 20 101 | 9/1998 |
| EP | 0 768 058 | 4/1997 |
| FR | 2 444 445 | 7/1980 |
| FR | 2 745 169 | 8/1997 |
| WO | WO 98/44837 | 10/1998 |

* cited by examiner

*Primary Examiner*—Duane S. Smith
(74) *Attorney, Agent, or Firm*—Barry R. Lipsitz; Douglas M. McAllister

(57) ABSTRACT

A vacuum cleaner is provided having a housing, a suction unit arranged therein and a suction pipe which enters the housing and is connected to the suction side of the suction unit via a dirt collecting container and a separating device. The closed dirt collecting container is adapted to be inserted into the housing and, when in the inserted position, be connected to the suction pipe in sealed manner via an intake opening and connected to the suction side of the suction unit in sealed manner via an extraction opening. The dirt collecting container is partially filled with fluid into which there enters a feed pipe that extends from the intake opening into the fluid. Deflector surfaces are arranged above the fluid-filling, said surfaces forming a multiply-deflected flow path between the upper surface of the fluid and the extraction opening for the suction current being passed through the fluid.

41 Claims, 5 Drawing Sheets

VACUUM CLEANER

This application is a continuation of international application No. PCT/EP00/02937 filed on Apr. 1, 2000.

BACKGROUND OF THE INVENTION

The invention relates to a vacuum cleaner having a housing, a suction unit arranged therein and a suction pipe which enters the housing and is connected to the suction side of the suction unit via a dirt collecting container and a separating device.

In vacuum cleaners, the dirt carried by the suction current is generally separated from the suction current by means of a filter and is then retained in a dirt collecting container. In many cases, such types of vacuum cleaner utilising a separating device in the form of a filter are very effective but, especially when separating extremely fine dust particles, it has been discovered that it is advantageous in many cases to perform the separation process by means of a fluid bath through which the suction current passes. However, the known devices of this type in which separation is effected in a fluid bath are of extraordinarily complicated construction and do not generally allow for the use of appliances of this type in private households.

The object of the invention is to construct a vacuum cleaner in such a manner that, on the one hand, the result of the separation process will be optimal, but one which will be of simple construction on the other so that uncomplicated appliances can be produced for private use.

SUMMARY OF THE INVENTION

In accordance with the invention, this object is achieved in the case of a vacuum cleaner of the type described hereinabove in that the closed dirt collecting container is adapted to be inserted into the housing and, when in the inserted position, is connected to the suction pipe in sealed manner via an intake opening and is connected to the suction side of the suction unit in sealed manner via an extraction opening, in that the dirt collecting container is partially filled with a fluid into which there enters a feed pipe that extends from the suction opening into the fluid, and in that deflector surfaces are arranged above the fluid-filling, whereby said surfaces located between the upper surface of the fluid and the extraction opening form a multiply-deflected flow path for the suction current that is being passed through the fluid.

In such a vacuum cleaner, use is made of a very specially constructed dirt collecting container which is closed on all sides and is insertable into the housing in the manner of a drawer or an insert. The suction pipe enters this dirt collecting container in such a manner that the outlet point of the suction pipe ends within a fluid-filling in the dirt collecting container so that the suction current will pass through the fluid-filling in the dirt collecting container. For the purposes of separating the fluid droplets that are drawn up thereby, there are arranged in the gaseous space above the fluid in the interior of the dust collecting container a plurality of deflector surfaces which form a multiply-deflected flow path so that the fluid droplets will be separated from the suction current which will then reach the suction unit through the extraction opening of the dirt collecting container free of dirt particles and free from fluid droplets.

After use, such a vacuum cleaner can be regenerated in the most simple of manners by extracting, and especially withdrawing, the closed dirt collecting container from the housing and then emptying it, for example through a special discharge opening, whereafter it is filled with fresh fluid, preferably water. A complex process of changing filter bags etc. is no longer necessary and, due to the completely closed construction of the dirt collecting container, the latter, together with its liquid filling, can be handled very easily since the dirt collecting container is inserted into the housing in the form of a separate unit and can be directly extracted therefrom.

The dirt collecting container may, for example, be substantially in the shape of a cuboid and may form a bucket-like vessel. For handling purposes, this vessel may be provided with a handle, for example, a swivel handle in the manner of a bucket.

It is especially advantageous if the dirt collecting container comprises a lower portion which is open at the upper end and is closed by means of a removable cover. This simplifies the processes of filling and emptying the dirt collecting container, and also the cleaning thereof.

It is advantageous hereby if the cover for the lower portion is sealed thereto by means of a seal.

In one preferred embodiment, the extraction opening is located in the cover.

Although excellent separation of the dirt particles can be achieved by means of the fluid filling alone, it is expedient if a filter is arranged in the extraction opening so as to enable the dirt particles that are drawn up by the suction current to be reliably and completely removed.

This filter may be in the form of an extractable insert.

In a preferred embodiment, provision is made for the filter to be connected via a seal to an extraction pipe leading to the suction side of the suction unit. The process of sealing the dirt collecting vessel relative to the extraction pipe is thereby effected by means of the filter.

It is expedient hereby, if the filter bridges in sealing manner a gap between the extraction pipe on the one hand and the extraction opening of the dirt collecting container on the other. One thereby obtains a method of checking as to whether the filter has been inserted correctly and is functioning properly. If the filter should fail unintentionally, leakage will occur in the vicinity of the gap and the vacuum cleaner will not work in the desired manner. The user is thus made aware of the failure of the filter.

In one advantageous embodiment, provision is made for the dirt collecting container to be slightly inclined in a downward direction relative to the direction of insertion of the dirt collecting container at least in the vicinity of the extraction opening so that a seal surrounding the extraction opening will just rest in sealing manner on a suction pipe leading to the suction side of the suction unit at the end of the insertion action. Firstly, such a design simplifies the insertion of the dirt collecting container since friction produced by the bearing surface of the seal only occurs towards the end of the insertion movement and secondly, seals that only come into contact with other parts immediately prior to the formation of the actual seal will be protected.

In a preferred embodiment, provision is made for an intake shaft to be mounted in front of the extraction opening disposed at the upper end of the dirt collecting container, said intake shaft completely covering the extraction opening and being laterally displaced relative thereto so that it is open at one side and thereby forms an inlet opening. Such an intake shaft diverts the suction current into the interior of the container and the lower face thereof forms a deflector surface at which the fluid droplets carried by the suction current are separated therefrom.

It is advantageous hereby if the intake shaft extends over the full width of the container.

Laterally projecting sealing strips, which closely abut the inner wall of the dirt collecting container, may be mounted on the open side of the intake shaft. It is thereby ensured that the suction current will have to pass through the inlet openings in the intake shaft and will not pass laterally thereby.

For preference, the lower end of the intake shaft may be flat and extend substantially parallel to the upper end of the dirt collecting container.

It is particularly expedient if the free edge at the lower end of the intake shaft supports a downwardly projecting, batten-like projection which narrows the cross-section of the flow in an abrupt manner and serves as a separating surface for the fluid droplets that have been drawn up thereby.

The intake shaft may be held on the cover on a dirt collecting container which is closed by means of a removable container.

Provision may be made for the inlet opening of the intake shaft to be sub-divided into two halves by a perpendicular partition wall, this thereby smoothing the turbulent flow in the interior of the dirt collecting container.

Surprisingly, it has been established that the separating effect produced by the fluid filling can be increased if the feed pipe is constructed with two substantially right-angled turns therein.

Furthermore, it is advantageous if the feed pipe enters the fluid in a direction perpendicular to the fluid level.

It is preferable for the feed pipe to enter the fluid at one side of the dirt collecting container in the vicinity of the rear wall thereof and approximately in the middle of the container.

In a particularly preferred embodiment, provision is made for the point of entry of the feed pipe into the fluid to be overhung by a hood through which the feed pipe is fed and which dips into the fluid at one end whilst the opposite end thereof is located outside the fluid. This hood thus forms a deflector surface in the gaseous space and defines a turbulent region in the vicinity of the point of entry of the feed pipe wherein the sucked-in air forms a vortex by virtue of which the air repeatedly enters the fluid and re-emerges therefrom. The degree to which the dirt particles are separated is thereby considerably improved.

It is advantageous if the end of the hood that dips into the fluid extends to the base of the dirt collecting container so that, in this region, the suction current entering the fluid cannot pass therethrough but is forced to emerge from the fluid in the region of the turbulent space formed by the hood and to then leave this turbulent space in the vicinity of the free edge of the hood.

The hood preferably has a curved cross-section whereby the concave face thereof faces the point of entry.

It is particularly expedient if the free edge of the hood that is located above the fluid level is curved downwardly and extends such that it ends virtually perpendicular relative to the fluid level. This free edge then forms a separating edge for the suction current at which separation of the water droplets is particularly effective.

In particular, the hood may extend to such an extent from the point of entry into the interior of the dirt collecting container that it covers the extraction opening. It thereby forms a multiply-bent flow path in conjunction with the lower end of the intake shaft.

Furthermore, provision may be made for the hood to extend over the full width of the dirt collecting container.

It is expedient hereby if the side edges of the hood abut the inner wall of the dirt collecting container in sealing manner so that the suction current cannot pass laterally by in this region.

In a preferred embodiment, provision is made for the interior space overhung by the hood to be sub-divided into a central chamber and two lateral chambers by means of two perpendicular partition walls in at least that part thereof adjoining the portion of the hood which dips into the fluid. The suction current emerging from the feed pipe enters the fluid in the central chamber, and this central chamber forms the actual turbulent space for the suction current, whereby the width thereof can be selected in a desired manner by means of the perpendicular partition walls.

It is advantageous hereby if the lateral chambers are narrow in comparison with the central chamber. For example, the width of the lateral chambers may amount to just 10% of the total width of the hood.

It is particularly advantageous if the hood comprises at least one passageway in the regions of each of the two lateral chambers that are below the fluid level. This passageway serves for balancing the level of the fluid on each side of the hood so that, in the region behind the hood i.e. in the part of the hood remote from the turbulent space in the hood, a build-up of fluid cannot occur but rather, the level of the fluid will always be the same throughout the whole of the dirt collecting container.

The perpendicular partition walls may extend over the whole interior space of the hood but, in a preferred embodiment, it is envisaged that the perpendicular partition walls should only extend over approximately half the length of the hood.

It is particularly advantageous if the hood is inserted into the dirt collecting container such that it is withdrawable therefrom. This enables each part of the dirt collecting container to be thoroughly cleaned.

The hood has a handle mounted thereon for this purpose.

In order to position the hood in the dirt collecting container, provision may be made for the side walls of the dirt collecting container to comprise seating surfaces for the hood. Such types of seating surfaces for the hood could also be arranged on the feed pipe so that, in this case, the seating surfaces would preferably be in the form of upwardly open grooves in which the rim of the hood engages.

Furthermore, it is advantageous if guide surfaces, which guide the hood into its end position whilst it is being inserted, are arranged on the side walls of the dirt collecting container. For example, the guide surfaces could be formed by inwardly projecting steps on the side walls of the dirt collecting container. The user then only has to insert the hood into the dirt collecting container but does not have to position it precisely since the precise positioning thereof is effected by the guide surfaces. The hood will therefore fall into the correct position automatically after it has been released.

It is also possible for the front part of the hood facing the free edge of the hood to be pivotally mounted on the rear part of the hood, preferably by means of a film hinge. This embodiment is particularly expedient when the hood is permanently fixed in the dirt collecting container since access to the part of the dirt collecting container located below the hood can then be obtained by raising the front part of the hood thereby allowing it to be easily cleaned.

It is preferable if the cross-section of the flow decreases between adjacent deflector surfaces in the direction of flow so that the speed of flow will increase, this thereby leading to optimal separation of the fluid droplets that have been drawn up therein.

It is expedient if the deflector surface arranged above the hood ends above the rear part of the hood. The fluid droplets dropping off the edge of the upper deflector surface will then drop into the space behind the hood and will no longer enter the suction current so that renewed charging of the suction current with water droplets will be avoided.

It is particularly expedient if at least some portions of the side walls of the dirt collecting container are deformable inwardly in a resilient manner. The side walls will then rest in sealing manner on the inserts during the operation of the vacuum cleaner when a low pressure region is produced in the interior of the dust collecting container by the suction unit, i.e. they will rest especially on the intake shaft and on the hood and thus reliably seal these inserts relative to the side walls so that the suction current cannot leave the predefined flow path.

In those regions of the side wall wherein such sealing is not necessary, some portions of the side walls may be stiffened, for example, by means of reinforcing ribs or by having thicker walls so as to thereby ensure that the dirt collecting container will have a stable overall structure despite the deformable side walls.

BRIEF DESCRIPTION OF THE DRAWINGS

The following description of preferred embodiments of the invention will serve for a more detailed explanation thereof in conjunction with the drawing. Therein.

DETAILED DESCRIPTION OF THE INVENTION

Figure 1:
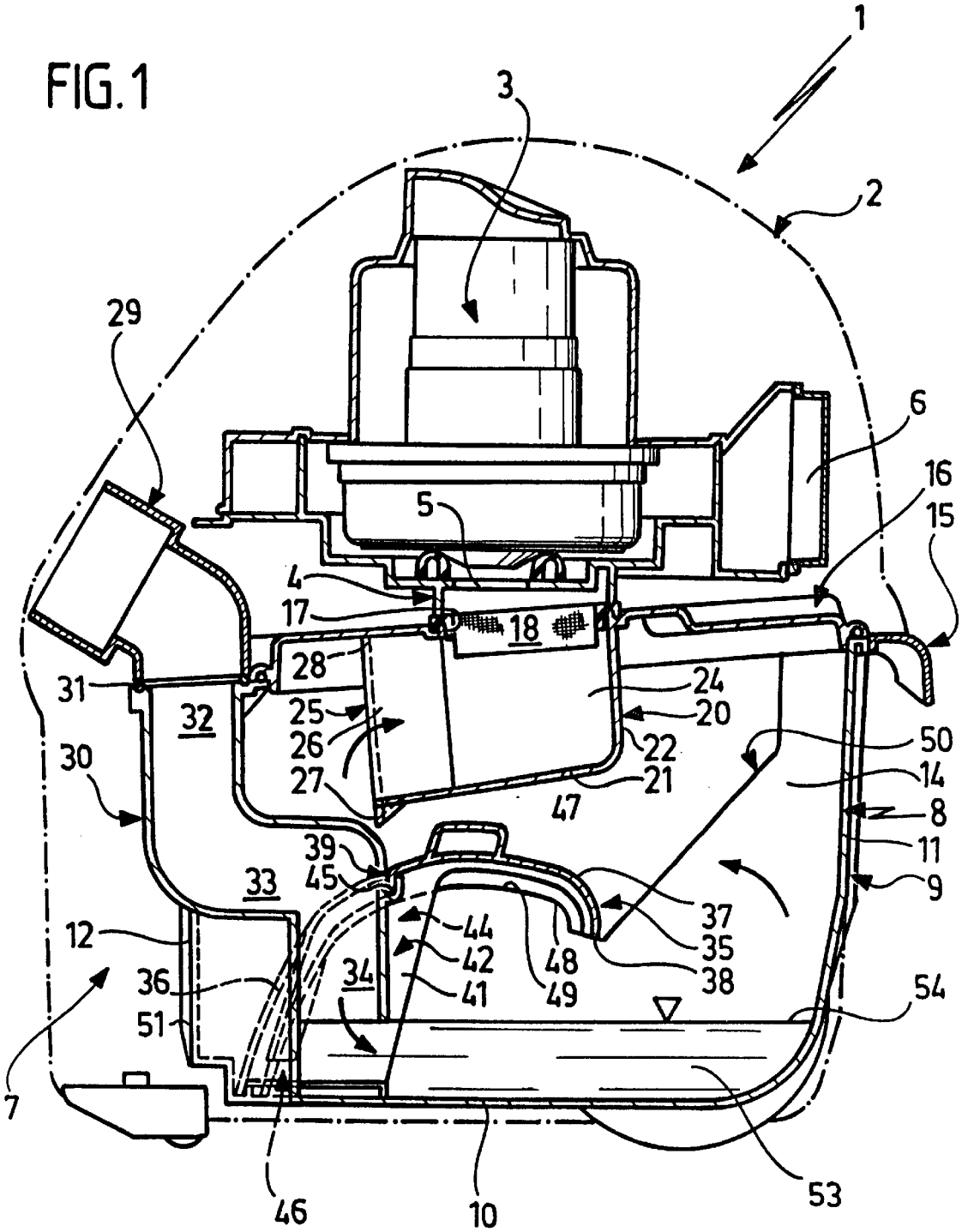
FIG. 1 shows a longitudinal sectional view of a vacuum cleaner having a dirt collecting container inserted therein.
Figure 2:
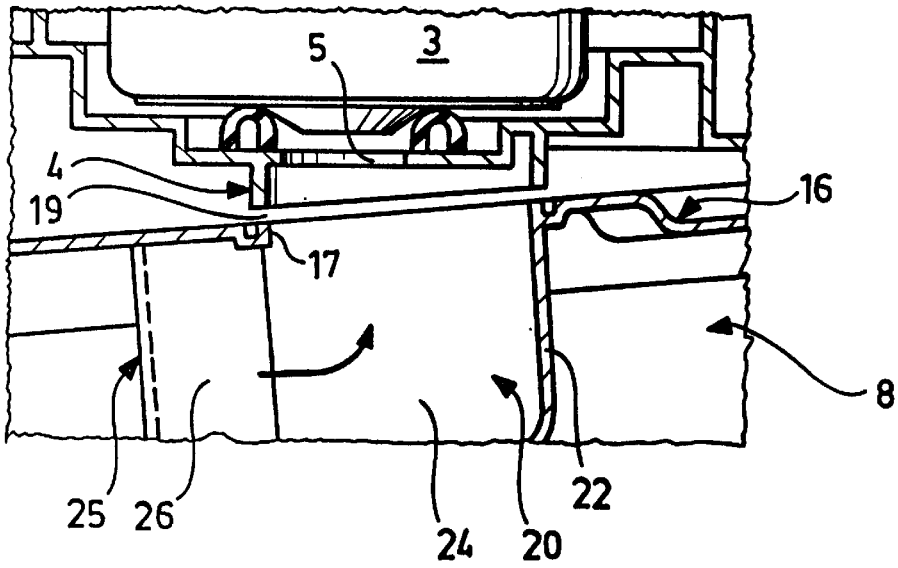
FIG. 2 an enlarged detailed view of the vacuum cleaner of FIG. 1 in the region of the extraction opening of the dirt collecting container but without a filter insert.
Figure 3:
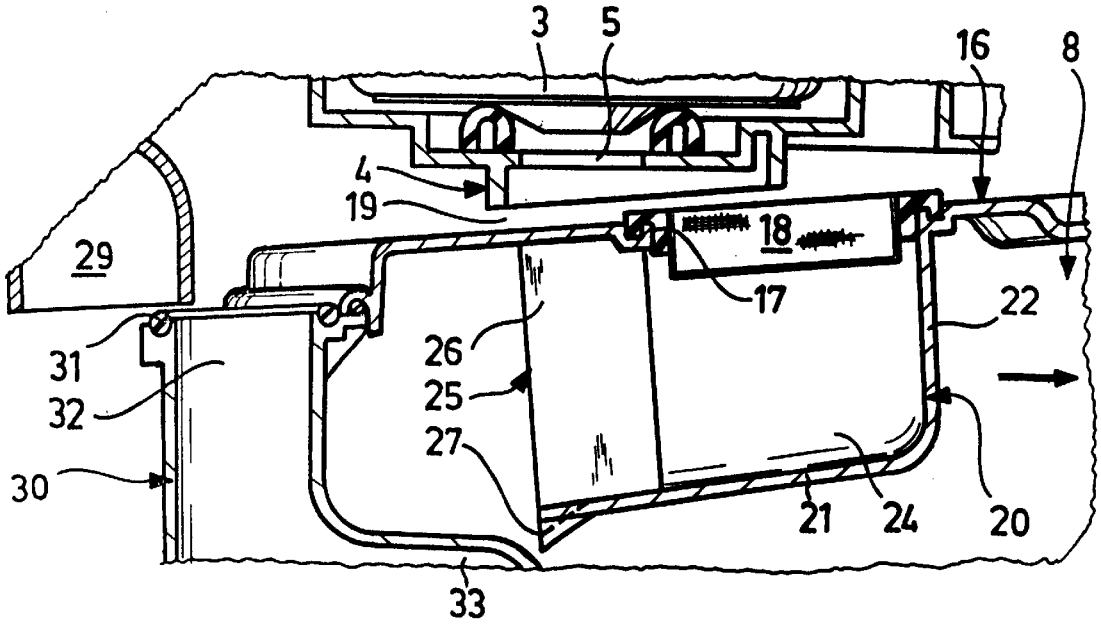
FIG. 3 an enlarged detailed view in accordance with FIG. 1 depicting the region of the upper end of the dirt collecting container during the withdrawal thereof from the housing.

The vacuum cleaner 1 illustrated in the drawing comprises a housing 2 which is only indicated by dash-dotted lines in FIG. 1. This housing is portable and accommodates a suction unit 3 in its upper portion, said suction unit comprising a suction opening 5 which is surrounded by an intake connecting piece 4 at its lower end and emitting the intake air to the surroundings via an outlet 6. Here, the intake connecting piece 4 is very short and ends in a plane which is slightly inclined relative to the horizontal (FIGS. 2 and 3).

A reception space 7 for a dirt collecting container 8, into which said space the dirt collecting container 8 can be pushed from the side, is disposed in the housing 2 below the suction unit 3.

This dirt collecting container 8 comprises a substantially cube-shaped tank-like lower portion 9 having a flat base 10, a perpendicular front wall 11 and a perpendicular rear wall 12 and also two perpendicular, parallel side walls 13, 14 which interconnect the front wall 11 and the rear wall 12. A carrying handle 15 is articulated to these side walls 13, 14 in pivotal manner so that the lower portion 9 of the dirt collecting container 8 can be carried in the manner of a bucket.

A substantially flat cover 16 is adapted to be placed on the lower portion 9, said cover resting on the upper rim of the lower portion 9 and being sealed relative thereto by means of a seal which is not particularly illustrated in the drawing so that the lower portion 9 is closed in sealed manner. The upper edge of the lower portion 9 and hence the cover 16 are slightly inclined relative to the horizontal base 10, namely, in a downward direction relative to the direction of insertion of the dirt collecting container 8, so that they extend substantially parallel to the lower edge of the intake connecting piece 4 (FIGS. 2 and 3).

A rectangular extraction opening 17, into which a filter insert 18 is adapted to be inserted in sealing manner, is formed in the cover 16 and extends over the whole width thereof. The rim of the filter insert 18 is likewise in the form of a seal which rests in sealing manner on the lower edge of the intake connecting piece 4 when the dirt collecting container 18 has been pushed into the housing 2 and thus forms a sealed connection between the interior of the dirt collecting container 8 and the intake connecting piece 4. This sealing process inevitably occurs when the dirt collecting container 8 is pushed-in since, due to the inclination of the lower edge of the intake connecting piece 4 and the inclination of the cover 16 and hence that of the extraction opening 17 and that of the filter insert 18, the sealing rim of the filter insert 18 only comes into contact with the lower rim of the intake connecting piece 4 when the dirt collecting container 8 reaches its fully inserted position, whereas prior to this point, said sealing rim of the filter insert 18 does not make contact with any other part so that the dirt collecting container 8 can easily be inserted and the filter insert 18 will not be subjected to any loading (FIG. 3).

A narrow gap 19, which is normally bridged in sealing manner by the filter insert 18 (FIG. 1), is formed between the cover 16 and the lower edge of the intake connecting piece 4 (FIG. 2) so that a sealed connection is formed between the interior of the dirt collecting container 8 and the suction unit 3.

However, if the filter insert 18 is inadvertently not inserted, this gap 19 will remain open as is illustrated in FIG. 2, whence a sealed connection between the interior of the dirt collecting container 8 and the suction unit 3 will not be formed so that the requisite low pressure cannot build-up in the interior of the dirt collecting container 8, the suction effect of the vacuum cleaner 1 will not occur and the user will thus be made aware that he should insert the filter insert 18.

Figure 7:
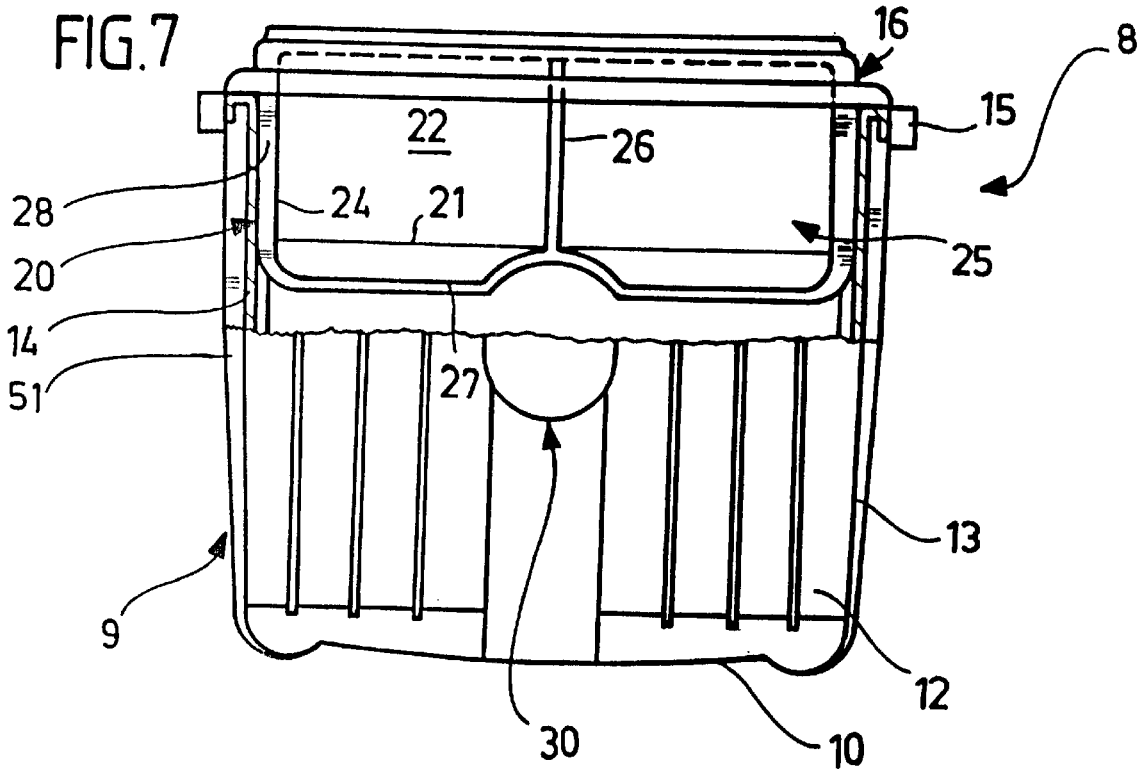
FIG. 7 a partially broken-away side view of the dirt collecting container and FIG. 8 a detailed sectional view through a preferred embodiment of a hood inserted in the dirt collecting container.

An intake shaft 20 is located below the lower face of the cover 16 in front of the extraction opening 17, said shaft being substantially in the form of a cuboid, extending over the whole width of the dirt collecting container 8 and being formed by a flat base surface 21 which extends in parallel with the cover 16, a rear wall 22 adjoining the extraction opening 17 and two side walls 23, 24. This intake shaft 20 is open at the side thereof opposite the rear wall 22, and the intake opening 25 is subdivided into two halves by a perpendicular partition wall 26 in the interior of the intake shaft 20 (FIG. 7).

The intake shaft 20 completely covers the extraction opening 17 and it extends beyond the extraction opening 17 so that the total length of the intake shaft 20 is approximately one and a half times greater than the length of the extraction opening 17.

A batten-like, downwardly oriented projection 27 forming a separating edge is provided on the base surface 21 below the intake opening 25.

Flange-like rims 28, which rest on the side walls 13 and 14 of the dirt collecting container 8 in sealing manner (FIG. 7), project from the side walls 23 and 24 laterally of the intake opening 25 so that the entire gas stream being extracted from the dirt collecting container 8 will be diverted through the intake opening 25.

Figure 4:
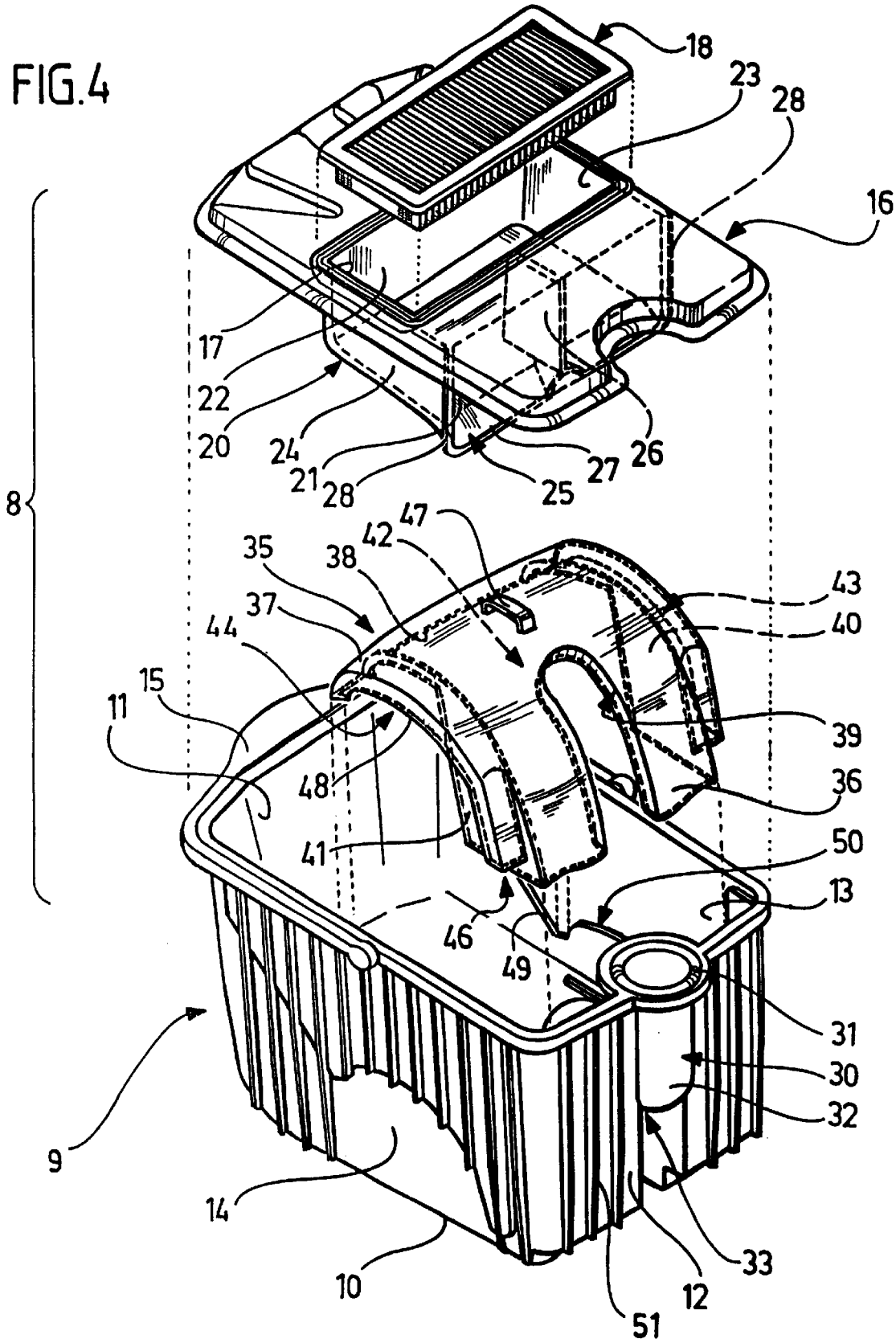
FIG. 4 a perspective view of the dirt collecting container and its components.
Figure 5:
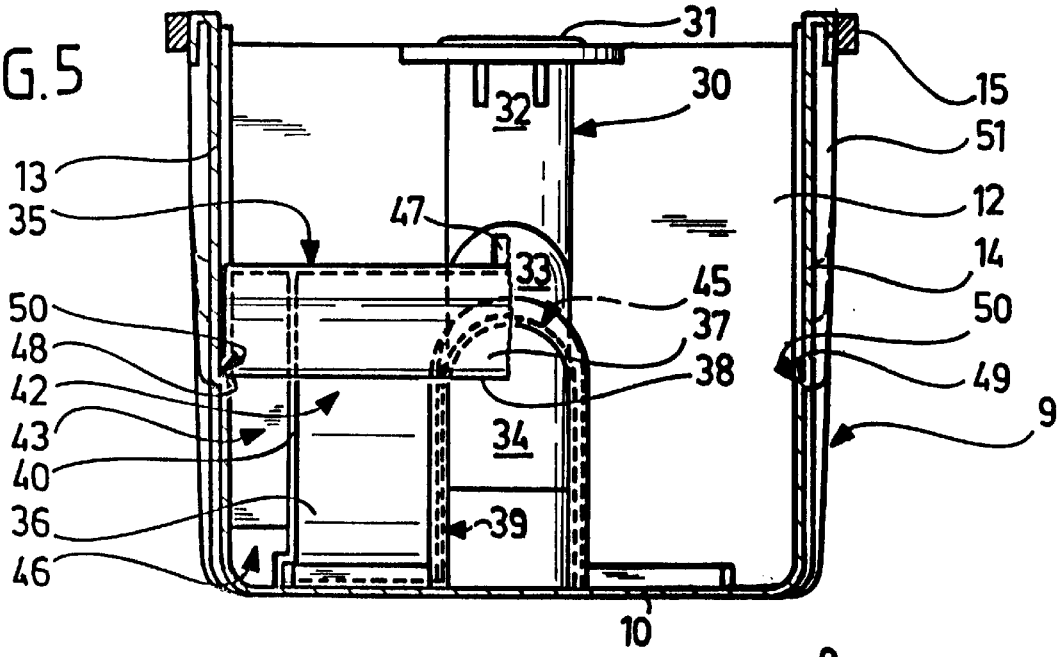
FIG. 5 a sectional view of the dirt collecting container along the line 5—5 in FIG. 6.

A suction connecting piece 29, which can be connected to a suction hose in a manner that is not apparent from the drawing, merges into the housing 2 close to the suction unit 3, said suction connecting piece ending in a plane which extends in parallel relative to the cover 16 of the inserted dirt collecting container 8 and at approximately the same height thereas. When the dirt collecting container 8 has been fully inserted, this suction connecting piece 29 abuts, in sealing manner, a feed pipe 30 which is arranged in the rear wall 12 of the lower portion 9 (FIG. 4). When inserting the dirt collecting container 8, this feed pipe 30 becomes aligned with the suction connecting piece 29 and forms a sealed connection for the intake air in conjunction with an inserted ring seal 31.

Figure 6:
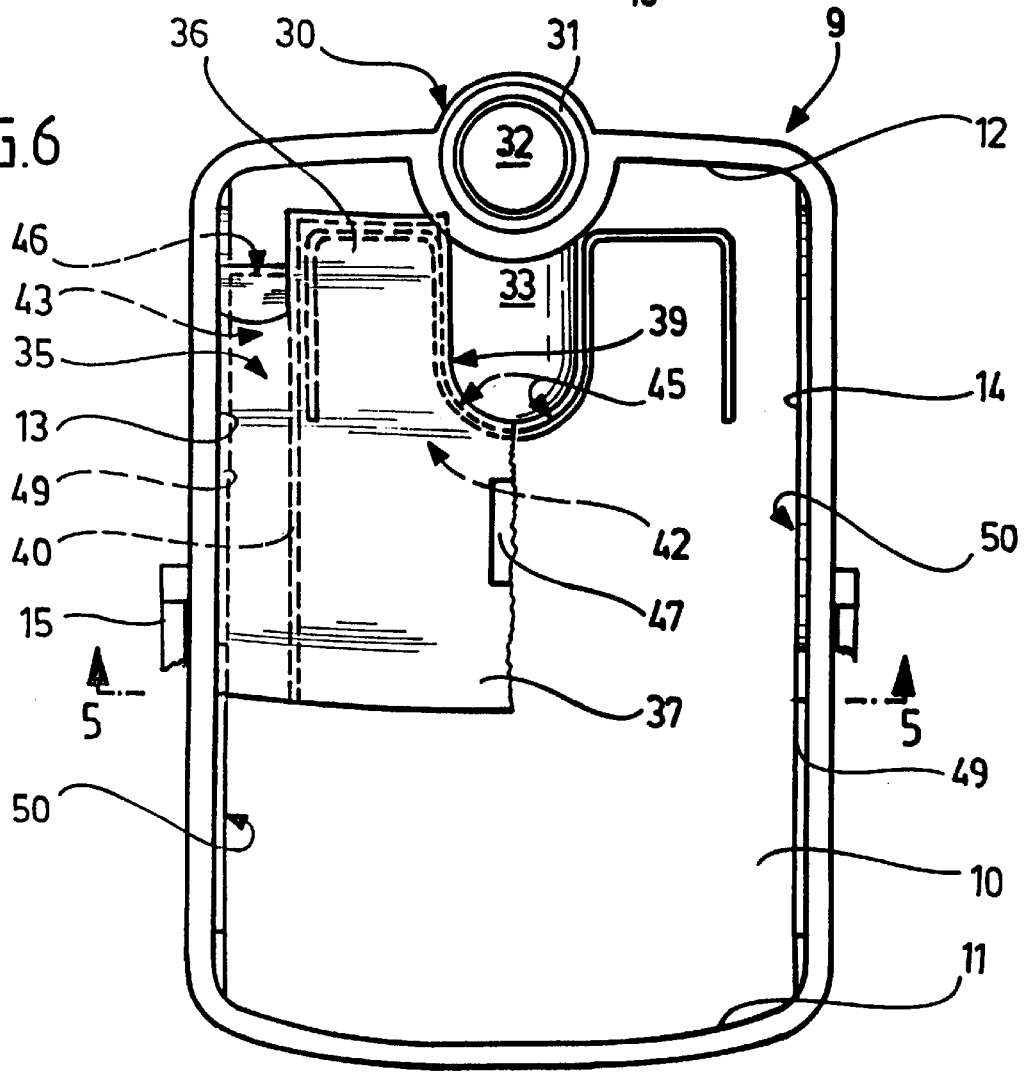
FIG. 6 a top view of the dirt collecting container.

In the immediate vicinity of the suction connecting piece 29, the feed pipe 30 initially has a perpendicular section 32 which changes into a horizontal section 33 at approximately half the height of the lower portion 9, and, adjoined to the horizontal section, it then comprises a further perpendicular section 34. This perpendicular section 34 ends a short distance above the base 10, it is displaced relative to the rear wall 12 by approximately the diameter of the feed pipe 30 and it is located in the centre of the lower portion 9 (FIG. 6).

The outlet region of the feed pipe 30 is overhung by a hood 35 which presses closely against the base 10 at the lower end of the rear wall 12 and begins with an upwardly inclined rear wall section 36 that changes into a front wall section 37 which has a curved cross-section and extends substantially below the intake shaft 20, and it ends in a downwardly curved somewhat perpendicularly extending free edge 38. Hereby, the hood 35 extends over the whole width of the lower portion 9. It comprises a slot-like break-through 39 in the rear wall section 36 through which the perpendicular section 34 of the feed pipe 30 projects.

On the inside of the hood 35 at each side of this slot-like break-through 39, there is arranged a respective perpendicular partition wall 40, 41, each of which extends over approximately half the cross-section of the hood 35 commencing from the rear wall section 36 and thereby subdivides the hood 35 into three chambers which are bounded by the rear wall section 36 and are formed in the transverse direction, namely, a central chamber 42 and two outer side chambers 43 and 44 adjoining each side thereof.

The perpendicular section 34 of the feed pipe 30 enters the central chamber 42 so that this central chamber 42 forms an eddy chamber for the suction current emerging from the feed pipe 30. This central chamber 42 is completely sealed in the vicinity of the rear wall section 36 by virtue of the fact that this rear wall section extends to the base 10 of the lower portion 9 and also by virtue of the fact that the rear wall section 36 presses closely against the perpendicular section 34 of the feed pipe 30 in the vicinity of the slot-like break-through 39. To this end, the perpendicular section 34 of the feed pipe 30 comprises an upwardly open seating groove 45 which extends along the periphery of said section and is matched to the shape of the rear wall section 36 of the hood 35, said groove accommodating the edge of the rear wall section 36 in the vicinity of the slot-like break-through 39 (FIG. 1).

The rear wall section 36 does not extend to the base 10 of the lower portion 9 in the area of the two side chambers 43 and 44, but rather, it ends slightly above the base 10 so that passageways 46 are formed in this region, said passageways interconnecting the part of the lower portion 9 overhung by the hood 35 to the part of the lower portion 9 located between the rear wall 12 and the rear wall section 36.

The front wall section 37 of the hood 35 is arranged below the base surface 21 of the intake shaft 20 in such a manner that a flow channel, which has a decreasing cross-section in the direction towards the batten-like projection 27, is formed between the upper face of the front wall section 37 and the base surface 21 (FIG. 1).

In the embodiment illustrated in FIGS. 1 to 7, the hood 35 is in the form of an independent component which can be lifted from the lower portion 9 of the dirt collecting container 8 with the aid of a handle 47 located on the upper side of the hood 35. When in the inserted state, the side edges 48 of the hood 35 rest on lateral steps 49 on the side walls 13 and 14 of the lower portion 9, and, moreover, the rims of the slot-like break-through 39 engage in the seating groove 45 in the manner described above. The hood 35 is thereby positioned in the lower portion 9 in the desired manner.

In order to make the insertion process easier, the side edges 48 are extended into inclined guide edges 50 upon which the hood 35 rests when cursorily inserted into the lower portion 9 and are guided in such a manner that they adopt their end position under the effects of gravity. Consequently, it is not necessary for the user to position the hood exactly since the exact positioning thereof is performed by the guide edges 50.

The hood 35 closely abuts the side walls 13 and 14 and, to this end, these side walls 13 and 14 may be resiliently bendable and flexible in the contacting region thereof so that in operation, when a low pressure occurs in the closed dirt collecting container 8, the side walls will be deformed inwardly and press closely against the side edges of the hood 35.

In those other regions of the side walls 13 and 14 whereat such a flexible contact is not desirable, the side walls 13 and 14 are strengthened by means of stiffening ribs 51.

Figure 8:
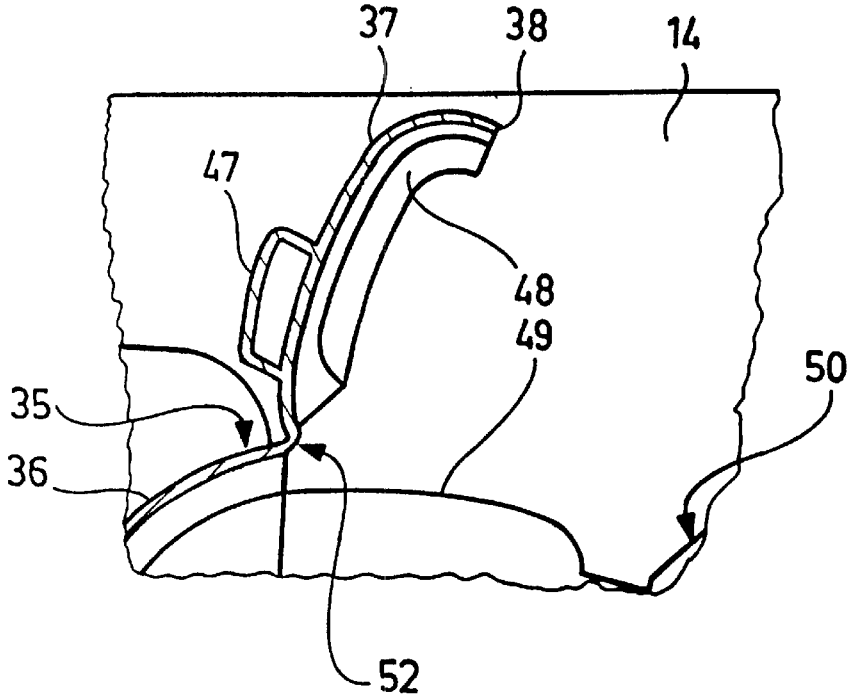

In the embodiment of FIG. 8, the front wall section 37 of the hood 35 is connected to the rear wall section 36 by means of a film hinge 52 so that the front wall section 37 can be folded upwardly thereby enabling access to the base of the lower portion 9, for example, for the purposes of cleaning. Such a pivotal movement is preferably provided when the hood 35 is fixed in the lower portion 9 and consequently cannot be withdrawn in the manner described above. Basically however, it would also be possible for a removable hood 35 to be provided with such an arrangement.

In operation, the dirt collecting container 8 is partially filled with a fluid 53, preferably with water. Hereby, the level 54 of the fluid is selected in such a manner that the perpendicular section 34 of the feed pipe 30 will end below the fluid level 54 and the passageways 46 will be located completely within the fluid 53. On the other hand however, the quantity of fluid 53 should be so limited that the fluid level 54 will end significantly below the front wall section 37 of the hood 35 so that, in every case, the front wall section 37 will be located above the fluid where it will form a deflector surface.

When the dirt collecting container 8 has been filled with a fluid 53 in this manner and it has been pushed into the housing 2, a suction current will be guided into the fluid 53 when the suction unit 3 is operational via the suction connecting piece 29 and the feed pipe 30, whereby a vortex will be formed in the central chamber 52. The formation of such a vortex is also assisted by the fact that the suction current is made turbulent by the two right-angled bends between the perpendicular section 32 and the horizontal section 33 on the one hand and the horizontal section 33 and the perpendicular section 34 on the other. The suction current and the fluid thereby mix intensively in the central chamber 42 so that dirt particles that have been drawn-up by the suction current will be retained in the fluid. The turbulent air passes the free edge 38 of the hood 35 and the latter deflects the accompanying fluid droplets downwardly due to its large downward curvature and separates them from the suction current, this then passing the free edge 38 and entering the gaseous space of the dirt collecting container 8 where it is deflected towards the passageway which is formed by the front wall section 37 of the hood 35 and the base surface 21 of the intake shaft 20. This deflection of the air stream through approximately 180° leads to the separation of the drawn-up fluid droplets.

The same applies in the aforesaid passageway which has a diminishing cross-section so that the speed of flow of the fluid is increased. A further separation of the drawn-up fluid droplets occurs especially in the region of the batten-like projection 27 and then there is a fresh deflection of 180° through the intake opening 25 of the intake shaft 20.

The cross-section thereof is selected such that it is larger than the cross-section of the passageway between the front wall section 37 and the base surface 21 so that the flow will slow up, this too contributing to the separation of residual droplets so that, following the multiple separation processes, the suction current can reach the suction unit 3 via the filter insert 18 in a substantially fluid-free state. Residual impurities are retained in the filter unit 18.

After use, the dirt collecting container 8 is withdrawn from the housing 2, the cover 16 is removed and the fluid is emptied out together with the dirt particles retained therein whereafter the fluid is replaced. The vacuum cleaner is then ready for operation with the new fluid filling.

The dirt collecting container 8 preferably consists entirely of synthetic material and is therefore easy to manufacture, and, moreover, it represents a very robust component so that it can be handled easily even in the private sphere.

What is claimed is:

1. A vacuum cleaner comprising:

a housing, a suction unit arranged in said housing, a suction pipe entering the housing and being connected to a suction side of the suction unit via a closed dirt collecting container adapted to be inserted into the housing and, when in the inserted position, being connected to the suction pipe in a sealed manner via an intake opening and being connected to the suction side of the suction unit in a sealed manner via an extraction opening, the dirt collecting container being at least partially fillable with a fluid into which a feed pipe enters, said feed pipe extending from the intake opening into the fluid at a point of entry, the dirt collecting container comprising a lower portion which is open at the upper end and is closed by means of a removable cover, deflector surfaces being arranged above the fluid, said surfaces forming a multiply-deflected flow path for a suction current passed through the fluid between the upper surface of the fluid and said extraction opening, said point of entry being overhung by a hood through which the feed pipe is fed and which dips into the fluid at one end while an opposite end thereof is located outside the fluid, and the end of the hood that dips into the fluid extending to a base of the dirt collecting container so that the suction current entering the fluid cannot pass therethrough.

2. A vacuum cleaner in accordance with claim 1, wherein the dirt collecting container is substantially in the form of a cuboid.

3. A vacuum cleaner in accordance with claim 1, wherein the cover is sealed to the lower portion by means of a seal.

4. A vacuum cleaner in accordance with claim 1, wherein the extraction opening is located in the cover.

5. A vacuum cleaner in accordance with claim 1, wherein a filter is arranged in the extraction opening.

6. A vacuum cleaner in accordance with claim 5, wherein the filter is in the form of an extractable insert.

7. A vacuum cleaner in accordance with claim 5, wherein the filter is connected via a seal to an extraction pipe leading to the suction side of the suction unit.

8. A vacuum cleaner in accordance with claim 7, wherein the filter bridges, in a sealing manner, a gap between the extraction pipe on the one hand and the extraction opening of the dirt collecting container on the other.

9. A vacuum cleaner comprising:

a housing, a suction unit arranged in said housing, a suction pipe entering the housing and being connected to a suction side of the suction unit via a closed dirt collecting container adapted to be inserted into the housing and, when in the inserted position, being connected to the suction pipe in a sealed manner via an intake opening and being connected to the suction side of the suction unit in a sealed manner via an extraction opening, the dirt collecting container being at least partially fillable with a fluid into which a feed pipe enters, said feed pipe extending from the intake opening into the fluid at a point of entry, deflector surfaces being arranged above the fluid, said surfaces forming a multiply-deflected flow path for a suction current passed through the fluid between the upper surface of the fluid and said extraction opening, said point of entry being overhung by a hood through which the feed pipe is fed and which dips into the fluid at one end while an opposite end thereof is located outside the fluid, the end of the hood that dips into the fluid extending to a base of the dirt collecting container so that the suction current entering the fluid cannot pass therethrough, and the dirt collecting container being slightly inclined in a downward direction relative to the direction of insertion of the dirt collecting container at least in the vicinity of the extraction opening so that, at the end of the insertion action, a seal surrounding the extraction opening just rests in sealing manner on a suction pipe leading to the suction side of the suction unit.

10. A vacuum cleaner comprising:

a housing, a suction unit arranged in said housing, a suction pipe entering the housing and being connected to a suction side of the suction unit via a closed dirt collecting container adapted to be inserted into the housing and, when in the inserted position, being connected to the suction pipe in a sealed manner via an intake opening and being connected to the suction side of the suction unit in a sealed manner via an extraction opening, the dirt collecting container being at least partially fillable with a fluid into which a feed pipe enters, said feed pipe extending from the intake opening into the fluid at a point of entry, deflector surfaces being arranged above the fluid, said surfaces forming a multiply-deflected flow path for a suction current passed through the fluid between the upper surface of the fluid and said extraction opening, said point of entry being overhung by a hood through which the feed pipe is fed and which dips into the fluid at one end while an opposite end thereof is located outside the fluid, the end of the hood that dips into the fluid extending to a base of the dirt collecting container so that the suction current entering the fluid cannot pass therethrough, and an intake shaft being mounted in front of the extraction opening disposed at the upper end of the dirt collecting container, said intake shaft completely covering the extraction opening and being laterally displaced relative thereto so as to be open at one side and thereby form an inlet opening.

11. A vacuum cleaner in accordance with claim 10, wherein the intake shaft extends over the full width of the dirt collecting container.

12. A vacuum cleaner in accordance with claim 11, wherein laterally projecting sealing strips, which abut closely against the inner wall of the dirt collecting container, are mounted on the intake shaft at the open side thereof.

13. A vacuum cleaner in accordance with claim 10, wherein the lower end of the intake shaft is flat and extends substantially parallel to the upper end of the dirt collecting container.

14. A vacuum cleaner in accordance with claim 10, wherein a free edge of the lower end of the intake shaft supports a downwardly projecting, batten-like projection.

15. A vacuum cleaner in accordance with claim 10, wherein the intake shaft is held on a cover which blanks off the dirt collecting container.

16. A vacuum cleaner in accordance with claim 10, wherein the inlet opening of the intake shaft is sub-divided into two halves by a perpendicular partition wall.

17. A vacuum cleaner comprising:

a housing, a suction unit arranged in said housing, a suction pipe entering the housing and being connected to a suction side of the suction unit via a closed dirt collecting container adapted to be inserted into the housing and, when in the inserted position, being connected to the suction pipe in a sealed manner via an intake opening and being connected to the suction side of the suction unit in a sealed manner via an extraction opening, the dirt collecting container being at least partially fillable with a fluid into which a feed pipe enters, said feed pipe extending from the intake opening into the fluid at a point of entry, the feed pipe comprising two substantially right-angled bends, deflector surfaces being arranged above the fluid, said surfaces forming a multiply-deflected flow path for a suction current passed through the fluid between the upper surface of the fluid and said extraction opening, and said point of entry being overhung by a hood through which the feed pipe is fed and which dips into the fluid at one end while an opposite end thereof is located outside the fluid, the end of the hood that dips into the fluid extending to a base of the dirt collecting container so that the suction current entering the fluid cannot pass therethrough.

18. A vacuum cleaner in accordance with claim 1, wherein the feed pipe enters the fluid in a direction perpendicular to the fluid level.

19. A vacuum cleaner in accordance with claim 1, wherein the feed pipe enters the fluid at one side of the dirt collecting container in the vicinity of a rear wall thereof and in the middle of the dirt collecting container.

20. A vacuum cleaner in accordance with claim 1, wherein the hood has a curved cross-section and a concave face thereof faces the point of entry.

21. A vacuum cleaner in accordance with claim 1, wherein a free edge of the hood that is located above the fluid level is curved downwardly and extends such that it ends substantially perpendicular relative to the fluid level.

22. A vacuum cleaner in accordance with claim 1, wherein the hood extends to such an extent from the point of entry into the interior of the dirt collecting container that it covers the extraction opening.

23. A vacuum cleaner in accordance with claim 1, wherein the hood extends over the full width of the dirt collecting container.

24. A vacuum cleaner in accordance with claim 23, wherein side edges of the hood abut the inner wall of the dirt collecting container in sealing manner.

25. A vacuum cleaner in accordance with claim 1, wherein the interior space overhung by the hood is sub-divided into a central chamber and two lateral chambers by two perpendicular partition walls in at least that region thereof adjacent to the part of the hood which dips into the fluid.

26. A vacuum cleaner in accordance with claim 25, wherein the lateral chambers are narrow in comparison with the central chamber.

27. A vacuum cleaner in accordance with claim 25, wherein the hood comprises at least one passageway in that region of each of the two lateral chambers that is below the fluid level.

28. A vacuum cleaner in accordance with claim 25, wherein the perpendicular partition walls only extend over approximately half the length of the hood.

29. A vacuum cleaner comprising:

a housing, a suction unit arranged in said housing, a suction pipe entering the housing and being connected to a suction side of the suction unit via a closed dirt collecting container adapted to be inserted into the housing and, when in the inserted position, being connected to the suction pipe in a sealed manner via an intake opening and being connected to the suction side of the suction unit in a sealed manner via an extraction opening, the dirt collecting container being at least partially fillable with a fluid into which a feed pipe enters, said feed pipe extending from the intake opening into the fluid at a point of entry, deflector surfaces being arranged above the fluid, said surfaces forming a multiply-deflected flow path for a suction current passed through the fluid between the upper surface of the fluid and said extraction opening, said point of entry being overhung by a hood through which the feed pipe is fed and which dips into the fluid at one end while an opposite end thereof is located outside the fluid, the end of the hood that dips into the fluid extending to a base of the dirt collecting container so that the suction current entering the fluid cannot pass therethrough, and the hood being inserted into the dirt collecting container such that it can be withdrawn therefrom.

30. A vacuum cleaner in accordance with claim 29, wherein the hood has a handle mounted thereon.

31. A vacuum cleaner in accordance with claim 29, wherein the side walls of the dirt collecting container comprise seating surfaces for the hood.

32. A vacuum cleaner in accordance with claim 29, wherein the feed pipe comprises a seating surface for the hood.

33. A vacuum cleaner in accordance with claim 32, wherein the seating surface is in the form of an upwardly open groove.

34. A vacuum cleaner in accordance with claim 29, wherein guide surfaces, which guide the hood into its end position when it is inserted, are arranged on the side walls of the dirt collecting container.

35. A vacuum cleaner in accordance with claim 34, wherein the guide surfaces are formed by inwardly projecting steps on the side walls of the dirt collecting container.

36. A vacuum cleaner comprising:

a housing, a suction unit arranged in said housing, a suction pipe entering the housing and being connected to a suction side of the suction unit via a closed dirt collecting container adapted to be inserted into the housing and, when in the inserted position, being connected to the suction pipe in a sealed manner via an intake opening and being connected to the suction side of the suction unit in a sealed manner via an extraction opening, the dirt collecting container being at least partially fillable with a fluid into which a feed pipe enters, said feed pipe extending from the intake opening into the fluid at a point of entry, deflector surfaces being arranged above the fluid, said surfaces forming a multiply-deflected flow path for a suction current passed through the fluid between the upper surface of the fluid and said extraction opening, said point of entry being overhung by a hood through which the feed pipe is fed and which dips into the fluid at one end while an opposite end thereof is located outside the fluid, the end of the hood that dips into the fluid extending to a base of the dirt collecting container so that the suction current entering the fluid cannot pass therethrough, and a front part of the hood facing a free edge thereof being pivotally mounted on a rear part of the hood.

37. A vacuum cleaner in accordance with claim 36, wherein the front part and the rear part of the hood are connected together by a film hinge.

38. A vacuum cleaner in accordance with claim 1, wherein the cross-section of the flow decreases between adjacent deflector surfaces in the direction of flow.

39. A vacuum cleaner in accordance with claim 1, wherein the deflector surface arranged above the hood ends above the rear part of the hood.

40. A vacuum cleaner in accordance with claim 1, wherein the side walls of the dirt collecting container are resiliently deformable inwardly in at least portions thereof.

41. A vacuum cleaner in accordance with claim 40, wherein the resiliently deformable side walls are stiffened in at least portions thereof.

* * * * *